US011795025B2

(12) United States Patent
Chatry et al.

(10) Patent No.: US 11,795,025 B2
(45) Date of Patent: Oct. 24, 2023

(54) STACKING DEVICE AND FORMING MACHINE OF SHEET-SHAPED ELEMENTS

(71) Applicant: BOBST MEX SA, Mex (CH)

(72) Inventors: Patrice Chatry, Lugrin (FR); Maude Steiner, Morrens (CH)

(73) Assignee: BOBST MEX SA, Mex (CH)

( * ) Notice: Subject to any disclaimer, the term of this patent is extended or adjusted under 35 U.S.C. 154(b) by 0 days.

(21) Appl. No.: 15/733,829

(22) PCT Filed: Apr. 25, 2019

(86) PCT No.: PCT/EP2019/025125
§ 371 (c)(1),
(2) Date: Nov. 30, 2020

(87) PCT Pub. No.: WO2019/238264
PCT Pub. Date: Dec. 19, 2019

(65) Prior Publication Data

US 2021/0214179 A1 Jul. 15, 2021

(30) Foreign Application Priority Data

Jun. 14, 2018 (EP) ..... 18020254

(51) Int. Cl.
*B65H 29/14* (2006.01)
*B65H 29/58* (2006.01)

(52) U.S. Cl.
CPC ..... *B65H 29/585* (2013.01); *B65H 29/14* (2013.01); *B65H 2301/51* (2013.01); *B65H 2555/11* (2013.01)

(58) Field of Classification Search
CPC .. B65H 29/585; B65H 29/14; B65H 2301/51; B65H 2555/11; B65H 31/26;
(Continued)

(56) References Cited

U.S. PATENT DOCUMENTS 4,828,246 A * 5/1989 Wegel ..... B65H 31/34 271/220
5,544,583 A 8/1996 Banike
(Continued)

FOREIGN PATENT DOCUMENTS

CN 104555545 A 4/2015
CN 106553927 A 4/2017
(Continued)

OTHER PUBLICATIONS

International Search Report dated Jul. 4, 2019, in counterpart International Patent Application No. PCT/EP2019/025125 (4 pages).

*Primary Examiner* — Thomas A Morrison
(74) *Attorney, Agent, or Firm* — Bookoff McAndrews, PLLC

(57) ABSTRACT

The invention relates to a stacking device (10) for placing sheet-shaped elements (P) in stacks in a forming machine (1), said stacking device (10) comprising:
- a movable stacking surface (11), and
- an actuating device (12) for moving stacking surface (11):
  - between a retracted position and a vertical forward position in a reciprocating back-and-forth motion for stacking sheets, and
  - between the retracted position and a stowed position to open an access to the stack of sheet-shaped elements (P),
- characterized in that the actuator (12) comprises cam means configured to move the stacking surface (11) upwardly in the retracted position, in a raised position to be located above the top of the sheet stack.

The invention also relates to a machine forming sheet-shaped elements comprising at least one such stacking device.

18 Claims, 4 Drawing Sheets

(58) Field of Classification Search
CPC ..... B65H 31/34; B65H 2405/1117; B65H 2405/11172; B65H 2405/11425
See application file for complete search history.

(56) References Cited

U.S. PATENT DOCUMENTS

| | | | | |
|---|---|---|---|---|
| 5,749,571 | A * | 5/1998 | Heiler | B65H 29/585 271/221 |
| 6,510,792 | B1 * | 1/2003 | Gunschera | B65H 31/34 101/232 |
| 8,960,664 | B2 * | 2/2015 | Maeda | B65H 1/00 399/110 |
| 10,144,608 | B2 * | 12/2018 | Koch | B65H 29/62 |
| 2006/0017217 | A1 * | 1/2006 | Maeda | B41J 29/13 347/108 |
| 2008/0217836 | A1 * | 9/2008 | Forch | B65H 29/585 270/58.33 |
| 2011/0311269 | A1 * | 12/2011 | Murooka | G03G 15/6502 399/119 |
| 2016/0347564 | A1 * | 12/2016 | Kasaishi | B65H 5/062 |

FOREIGN PATENT DOCUMENTS

| | | | |
|---|---|---|---|
| CN | 107082309 | A | 8/2017 |
| DE | 4442385 | C1 | 1/1996 |
| DE | 102009046987 | A1 | 5/2011 |
| JP | S59108759 | U | 7/1984 |
| JP | S61127564 | A | 6/1986 |
| JP | H06305627 | A | 11/1994 |
| JP | H08231112 | A | 9/1996 |
| JP | 2016094282 | A | 5/2016 |
| JP | 2019127379 | A | 8/2019 |
| TW | 200400149 | A | 1/2004 |

* cited by examiner

Fig.1
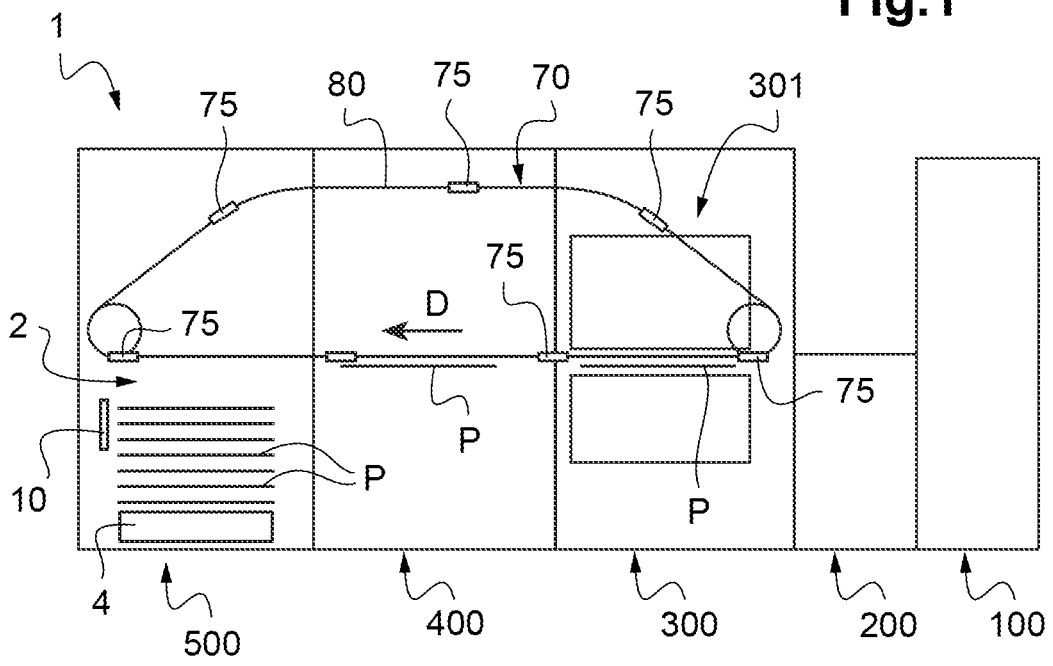
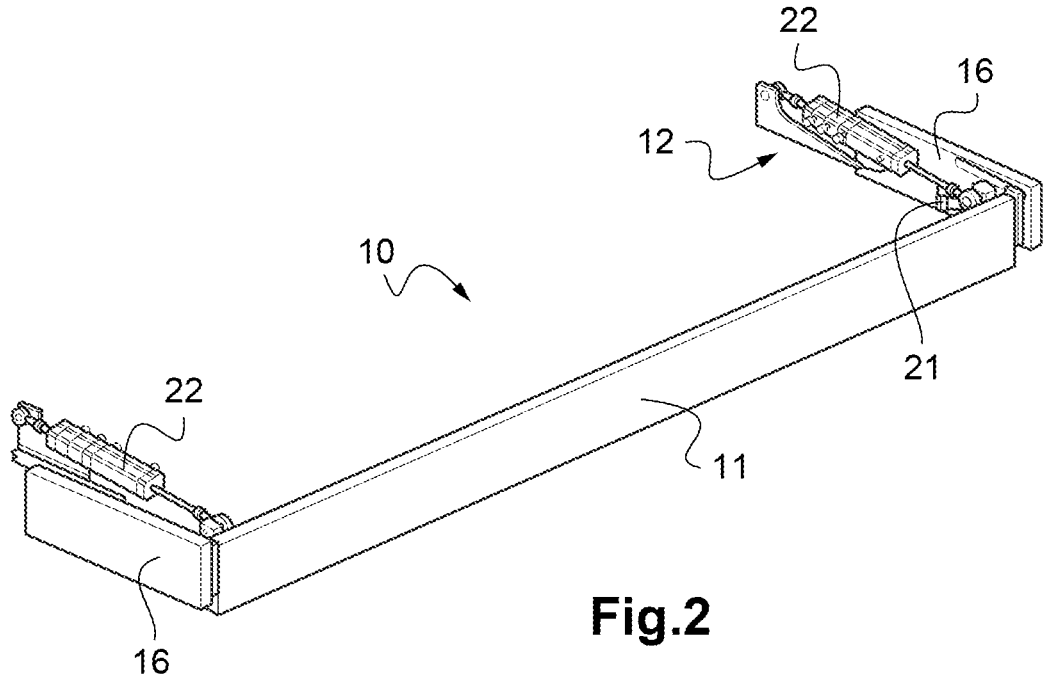
Fig.2

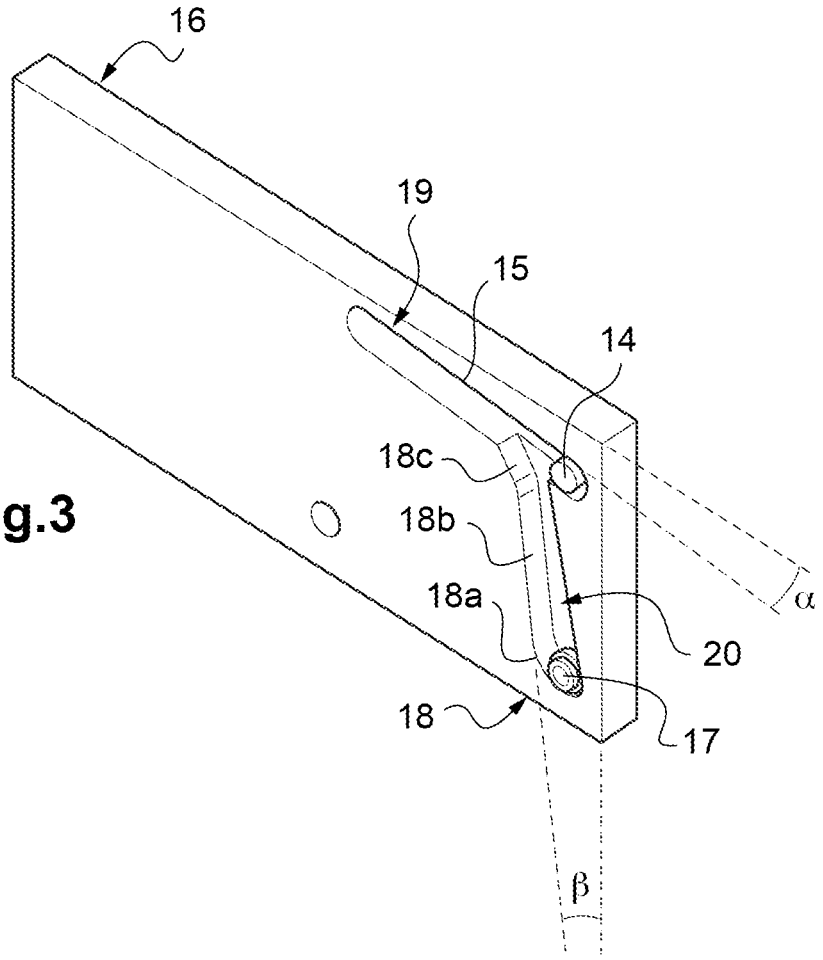
Fig.3
Fig.4
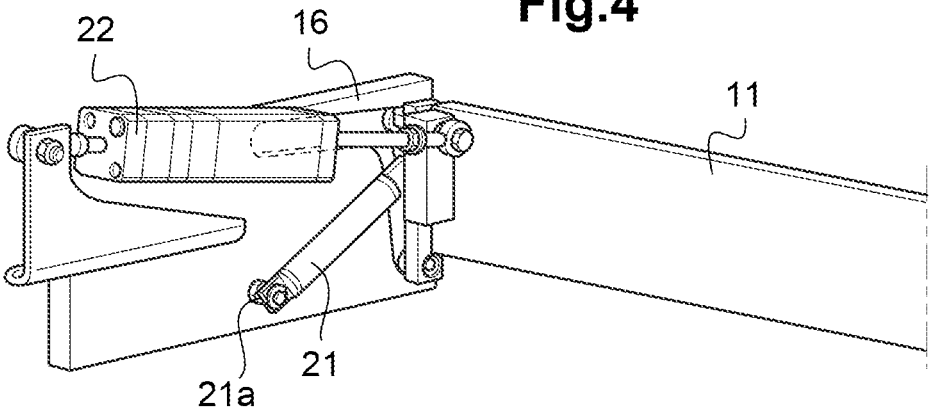

Fig.5A
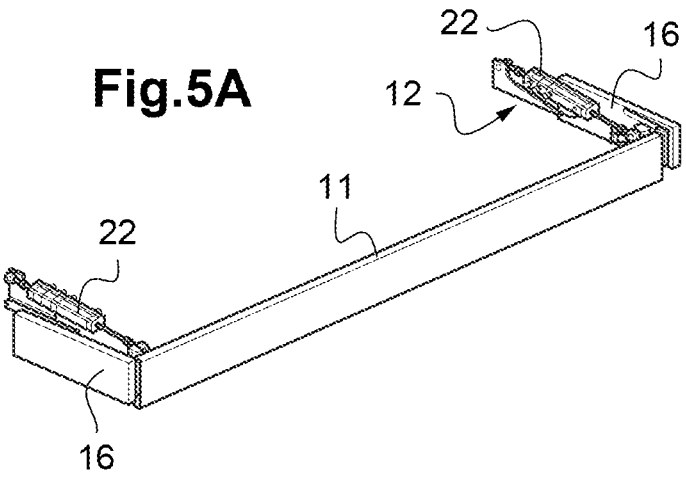
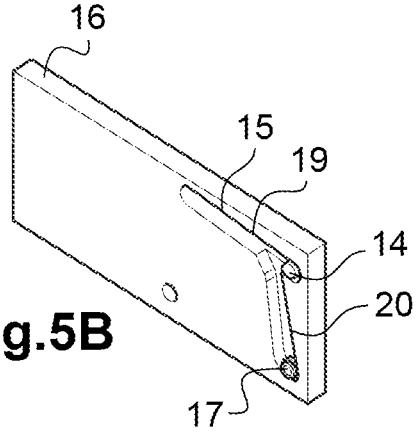
Fig.5B
Fig.6A
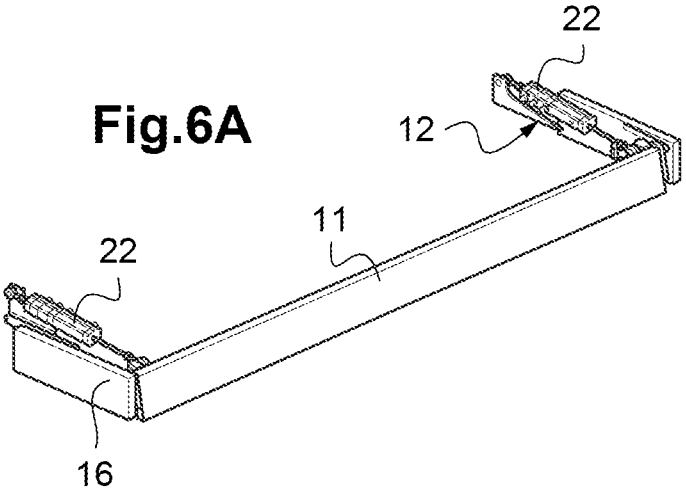
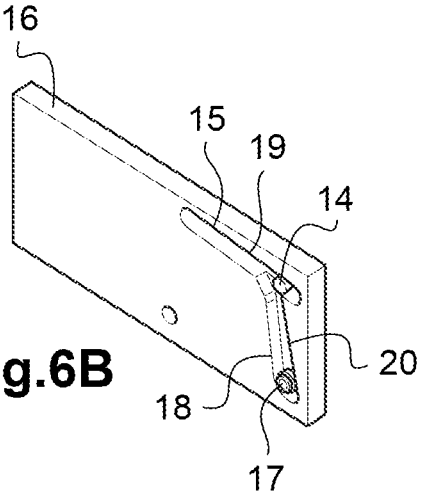
Fig.6B
Fig.7A
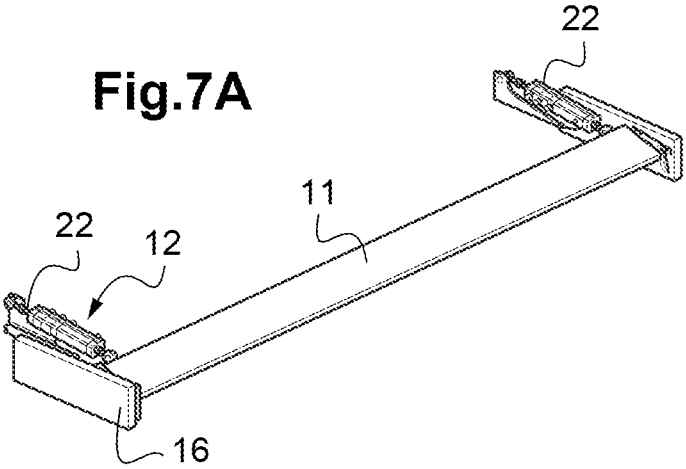
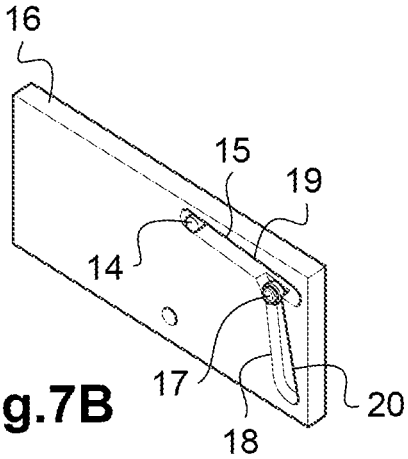
Fig.7B

STACKING DEVICE AND FORMING MACHINE OF SHEET-SHAPED ELEMENTS

CROSS-REFERENCE TO RELATED APPLICATION(S)

This application is a National Stage under 35 U.S.C. § 371 of International Application No. PCT/EP2019/025125, filed on Apr. 25, 2019, which claims priority to European Patent Application No. 18020254.1, filed on Jun. 14, 2018, the contents of all of which are incorporated by reference in their entirety.

The present invention relates to a device for stacking sheet-shaped elements in a forming machine. The invention also relates to a machine forming sheet-shaped elements comprising at least one such stacking device.

In the packaging manufacturing industry, sheets are cut, for example, in a matrix corresponding to the shape developed as desired, e.g. to obtain a plurality of boxes of a given shape. After cutting and ejecting waste, the attachment points between laid sheets are broken and laid sheets are stacked in a reception area where they are stacked in vertical piles using a stacker.

At the arrival of each new sheet, a stacking grid actuated by articulated arms pivots slightly from an inclined position to a vertical position, in order to accommodate and stack the sheet. The stacking grid then returns to its inclined "funnel" position for receiving a new sheet. This back-and-forth reciprocating movement of the stacking grid is also called "jogging movement".

In order to control the shaping quality of the sheets, samples are sampled regularly during production.

Therefore, some systems open an access to the stack at the location of the stacker, by folding the arms that pivot the stacking grid backwards and downwards. When the arms are folded, the stacking grid has also rotated horizontally but still remains in front of the stack, in the path accessing the stack. Hence, the access to the stack that opens above the grid is narrow, which does not facilitate the operator's work wishing to take a sample. U.S. Pat. No. 5,544,583 or 5,749,571 provide other examples.

Therefore, one of the aims of the present invention is to propose a device for stacking sheets that provides for an easier sampling of sheets.

For this purpose, the subject of the present invention is a stacking device for stacking sheet-shaped elements in a forming machine, the stacking device comprising:

A mobile stacking surface, and

An actuating device for moving the stacking surface:

between a retracted position and a vertical forward position in a reciprocating back-and-forth motion for stacking the sheets, and between the retracted position and a stowed position to open an access to the stack of sheet-shaped elements, characterized in that the actuator comprises cam means configured to move the stacking surface upwardly in the retracted position, in a raised position meant to be located above the top of the sheet stack.

The access to the sheet stack is thus open over its entire height.

Therefore, the cam means comprise at least a first follower roller secured to the stacking surface and at least a first control profile cooperating with the at least one first follower roller to guide said movement of the stacking surface.

According to one example of embodiment, the cam means, comprising the at least one first follower roller and the at least one first control profile configured to move the stacking surface between the retracted position and the upwards stowed position, are the same as those configured to move the stacking area between said retracted position and the vertical forward position in the back-and-forth reciprocating motion for stacking the sheets.

Guiding the movements of the stacking surface by the at least one first follower roller and the at least one first control profile, instead of an articulated pivot axis, allows to retract the stacking surface above the sheet stack. It is thus possible to provide, in a simple, robust, and economical manner, appropriate movements of the stacking surface by optimizing the functional design of the at least one first control profile so as to open a wide access to the stack in the reception area for easy sampling of sheet-shaped elements.

According to one example of embodiment, the at least one first control profile is straight.

The straight part of the at least one first control profile forms, for example, an angle of less than 30° with the horizontal.

The cam means comprise at least one second follower roller secured to the stacking surface below the at least one first follower roller, and at least one second control profile cooperating with the at least one second follower roller.

A first portion of the at least one second control profile is curved to guide the movement of the stacking surface between the retracted position and the vertical forward position, and a second portion of the second control profile is straight to guide the movement of the stacking surface between the retracted position and the stowed position.

According to one example of embodiment, the cam means, comprising the at least one second follower roller and the at least one second control profile configured to move the stacking surface between the retracted position and the upwards stowed position, are the same as those configured to move the stacking area between said retracted position and the vertical forward position in back-and-forth reciprocating motion for stacking the sheets.

The straight part of the second portion of the at least one second control profile forms, for example, an angle of less than 30° with the vertical.

The second portion of the second control profile crosses, for example, the direction of the first control profile.

The follower rollers are arranged on the stacking surface, for example, so that their cooperation with the control profiles in the stowed position moves the stacking surface in a raised position by forming an angle of less than 30° with the horizontal.

The at least one first control profile and the at least one second control profile may be offset laterally to prevent the at least one first follower roller from cooperating with the at least one second control profile, especially when the first follower roller following the first control profile returns from the stowed position and crosses the second control profile.

The at least one first or second control profile is, for example, formed in a groove.

The actuating device may comprise at least one elastic member having a fixed end and an end secured to the stacking surface to ensure contact of the at least one first follower on the at least one first control profile and, as appropriate, the at least one second follower roller on the at least one second control profile. The elastic member ensures that the follower rollers press on a respective control profile.

According to one example of embodiment, the cam means comprise two first follower rollers, each secured to a respective end of the stacking surface and two first control profiles cooperating with a respective first follower roller.

According to one example of embodiment, the cam means comprise two second follower rollers, each secured to a respective end of the stacking surface below a first follower roller, and two second control profiles cooperating with a respective second follower roller.

The actuating device comprises, for example, at least one actuator to cause the displacement of the stacking surface.

The at least one actuator comprises, for example, a double pneumatic jack configured to move the stacking surface between the retracted position and the vertical forward position over a short stroke and to move the stacking surface between the retracted position and the stowed position on a long stroke.

The invention also pertains to a machine for shaping sheet-shaped elements, characterized in that it comprises at least one sheet-shaped stacking device as described above.

SUMMARY DESCRIPTION OF THE DRAWINGS

Other advantages and characteristics will be revealed upon reading the description of the invention, as well as from the appended figures which represent a non-limiting example of embodiment of the invention and in which:

FIG. 1 illustrates very schematically an example of a forming machine of sheet-shaped elements.

FIG. 2 shows a perspective view of a stacking device of the forming machine of FIG. 1.

FIG. 3 shows a perspective view of elements of an actuating device of the stacking device of FIG. 2.

FIG. 4 shows a partial perspective view of a detail of the stacking device of FIG. 2.

FIG. 5A shows a perspective view of elements of the stacking device of FIG. 2 with the stacking surface in a vertical forward position.

FIG. 5B shows the elements of the actuator of FIG. 3 in vertical forward position.

FIG. 6A shows a view similar to FIG. 5A with the stacking surface in retracted position.

FIG. 6B shows a view similar to FIG. 5B in retracted position.

FIG. 7A shows a view similar to FIG. 5A with the stacking surface in stowed position.

FIG. 7B shows a view similar to FIG. 5B in stowed position.

Figure 8A:
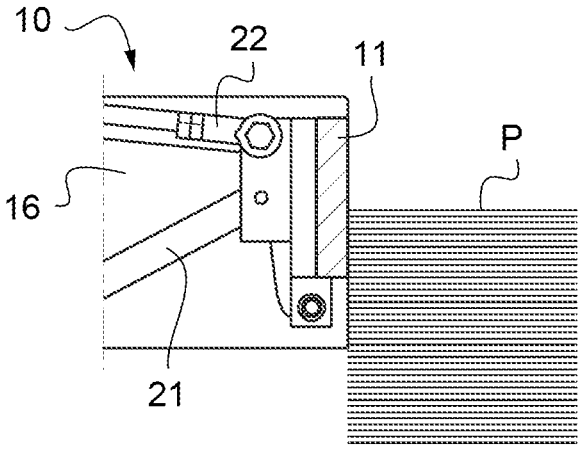
FIG. 8A shows a side view of a stack of sheet-shaped elements and of the actuator of FIG. 2 with the stacking surface in vertical forward position.

In these figures, identical elements have the same reference numbers. The following embodiments are examples. Although the description refers to one or more embodiments, this does not necessarily mean that each reference relates to the same embodiment, or that the features apply only to a single embodiment. Simple features of different embodiments may also be combined or interchanged to provide other embodiments.

The upstream and downstream terms are defined with reference to the longitudinal direction of D sheet motion (FIG. 1). The sheets move from upstream to downstream, generally following the longitudinal main axis of the machine, in a motion clocked by periodic stops.

The terms "sheet-shaped elements" and "sheets" shall be considered equivalent, and shall include corrugated board as well as cardboard, paperboard or other materials commonly used in the packaging industry. It will be understood that throughout this text, the terms "sheet" or "sheet element" or "sheet-shaped element" refer in a very general manner to any sheet-shaped printing medium such as, for example, sheets of cardboard, paper, plastic, etc.

The terms "above", "below", "up", "down" "horizontal" and "vertical" are defined with reference to the arrangement of the elements in a forming machine placed on the ground.

FIG. 1 shows an example of a forming machine 1 for sheet transformation. This forming machine 1 is conventionally composed of several work stations which are juxtaposed but interdependent one by one to form a unitary assembly. Therefore, there is an introduction station 100, a margin table 200, a transformation station 300, for example, for cutting, embossing or stamping the sheets, such as comprising a deck press 301, a waste ejection station 400 in case of a cutting machine, or a strip feed station 400 in case of a stamping machine, a sheet receiving station 500 where the transformed sheets are reconditioned in stack.

The transformation operation of each sheet takes place in transformation station 300, for example, between a fixed deck and a lower movable deck of press 301 for cutting the sheets according to a matrix corresponding to the developed shape wished to be obtained, for example, in order to obtain a plurality of boxes of a given shape. The movable deck rises and lowers successively once during each machine cycle.

A transport device 70 is further provided to move each sheet individually from the outlet of margin table 200 to sheet receiving station 500, passing through transformation station 300 by press.

Transport device 70 comprises a plurality of transverse bars provided with clamps, commonly known as gripper bars 75, each of which, in turn, grabs a sheet at its front edge, before successively pulling it into the different stands of stations 300, 400, 500 of machine 1.

The lateral extremities of gripper bars 75 are each connected respectively to a side chain forming a loop, commonly called chain train 80. Two chain trains 80 are thus arranged laterally on each side of gripper bars 75.

By means of a motion transmitted to chain trains 80, the set of gripper bars 75 starts from a stopped position, accelerates, reaches a maximum speed, decelerates, then stops, thereby describing a cycle corresponding to the displacement of a sheet from one workstation to the next workstation. Chain trains 80 move and periodically stop so that, during each movement, all sheet gripper bars 75 are moved from one station to the adjacent downstream work station. Each station performs its work in synchronism with this cycle, which is commonly called a machine cycle. Workstations start a new job each time the machine starts.

The number and nature of the processing stations in a forming machine 1 may vary depending on the nature and complexity of the operations to be performed on the sheets. In the context of the invention, the concept of forming machine 1 thus covers a very large number of embodiments because of the modular structure of these assemblies. Depending on the number, nature, and arrangement of the workstations used, it is indeed possible to obtain a multitude of different processing machines. It is also important to point out that there are other types of workstations than those mentioned, such as embossing, forging, or such as stamping strip loading stations for stamping machines or hot foil stamping machines, where patterns applied on each sheet from a film coming from one or more stamping strips is carried out between the decks of a press. Finally, it is understood that the same forming machine may very well be equipped with several stations of the same type.

In sheet receiving station 500, transformed sheets are stacked in a vertical pile in receiving zone 2, for example, on a vertically movable reception pallet 4.

Forming machine 1 further comprises at least one stacking device 10, arranged in the sheet receiving station 500, for stacking the transformed sheets into stacks.

Forming machine 1 comprises, for example, two stacking devices 10 oriented opposite a respective face of the stack of sheets, a fixed stop being arranged on the other side of the stack for each stacking device 10. There is, for example, one front stacking device and one side stacking device per machine 1.

As can be seen in FIG. 2, stacking device 10 has a movable stacking surface 11 and an actuating device 12 for moving stacking surface 11 between a retracted position and a vertical forward position in a reciprocating back-and-forth motion for stacking sheets, and between the retracted position and a stowed position to release access to the stack of sheet-shaped elements P.

Stacking surface 11 has a flat surface, for example, formed in a deck that can be ribbed and/or perforated, such as a grid.

Figure 8B:
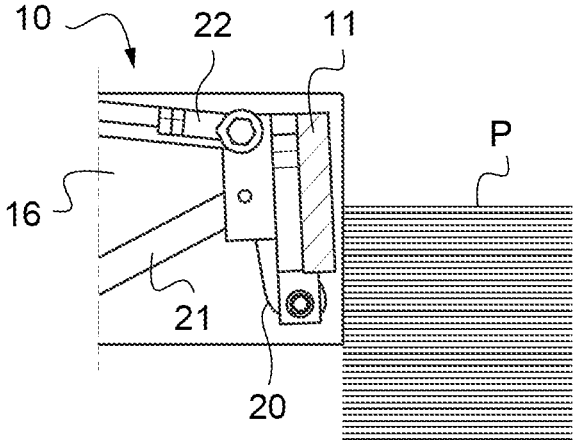
FIG. 8B shows a view similar to FIG. 8A with the stacking surface in retracted position.

Stacking surface 11 is movable according to a jogging movement, i.e. as a reciprocating back-and-forth movement between the vertical forward position (FIG. 5A, 8A) and the retracted position (FIG. 6A, 8B). The jogging movement of stacking surface 11 allows the sheets to be stored after shaping to make a stack. This movement is performed at each sheet reception, for example, about two or three times per second.

Stacking surface 11 is also movable in the stowed position (FIG. 7A, 8C) to open the access to the stack of sheet-shaped elements P.

Figure 8C:
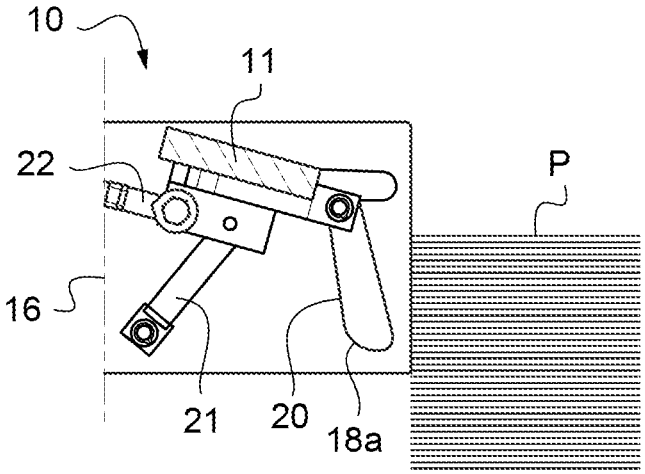
FIG. 8C shows a view similar to FIG. 8A with the stacking surface in stowed position.

Actuator 12 includes cam means configured to move stacking surface 11 upwardly in a retracted position, in a raised position to be located above the top of the sheet stack (FIG. 8C).

The access to the sheet stack is thus open over its entire height.

For this purpose, for example, the cam means comprise at least one first follower roller 14 secured to stacking surface 11, at one extremity thereof (FIGS. 3 and 4) and at least one first control profile 15, for example, arranged in a support 16 of stacking device 10 (FIG. 3), cooperating with the at least one first follower roller 14 to guide the movements of stacking surface 11.

According to one example of the embodiment, the cam means, comprising the at least one first follower roller 14 and the at least one first control profile 15 configured to move stacking surface 11 between the retracted position and the upward stowed position, are the same as those configured to move stacking area 11 between said retracted position and the vertical forward position in the back-and-forth reciprocating motion for stacking the sheets.

Guiding the displacements of stacking surface 11 by the at least one first follower roller 14 and the at least one first control profile 15, instead of an articulated pivot axis, allows for stacking surface 11 to be stowed away and above the stack of sheets. It is thus possible to provide, in a simple, robust, and economical manner, appropriate movements of stacking surface 11 by optimizing the functional design of the at least one first control profile 15, to open a broad access to the stack in reception area 2 for easy sampling of sheet-shaped elements P.

The at least one first control profile 15 is, for example, straight (FIG. 3). A same straight part then guides the at least one first follower roller 14 between the three positions, so there is no discontinuity to move stacking surface 11. Guiding of stacking surface 11 on the jogging movement represents a small proportion of this straight control profile, such as less than 10% of the first control profile 15. The straight part of the at least one first control profile forms, for example, an angle $\alpha$ of less than 30° with the horizontal.

The cam means further comprise at least one second follower roller 17 secured to stacking surface 11 below the at least one first follower roller 14 and at least one second control profile 18 cooperating with the at least one second follower roller 17 (FIG. 3).

According to one example of embodiment, the cam means, comprising the at least one first follower roller 17 and the at least one first control profile 18 configured to move stacking surface 11 between the retracted position and the upward stowed position, are the same as those configured to move stacking area 11 between said retracted position and the vertical forward position in the back-and-forth reciprocating motion for stacking the sheets.

A first portion 18*a* of the at least one second control profile 18 is curved, such as forming a loop portion, in order to guide stacking surface 11 movement between the retracted position and the vertical forward position. The curved shape of second control profile 18 causes a slight pullback of stacking surface 11 in the retracted position in addition to its pivoting.

A second portion 18*b* of second control profile 18 is straight so as to guide the movement of stacking surface 11 between the retracted position and the stowed position. First portion 18*a* and second portion 18*b* are adjacent and continuous so as to move stacking surface 11 continuously between the three positions. The straight part of the second portion of the at least one second control profile 18 forms, for example, an angle □ of less than 30° with the vertical.

Second portion 18*b* of second control profile 18 crosses the direction of first control profile 15, for example, at the end of the small proportion of said control profile 15.

Second control profile 18 may further comprise a third portion 18*c*, located at the end of second portion 18*b* and forming an inclined straight part with which second follower roller 17 cooperates in the stowed position (FIGS. 3 and 7B).

Follower rollers 14, 17 are arranged on stacking surface 11, for example, so that their cooperation with control profiles 15, 18 in the stowed position moves stacking surface 11 in a raised position by forming an angle of less than 30° with the horizontal.

Therefore, in the vertical forward position, stacking surface 11 is placed vertically and pushes the sheet to stack it (FIG. 5A, 8A). In the retracted position, stacking surface 11 has pivoted and slightly shifted back from the stack (FIG. 6A, 8B). In the stowed position (FIG. 7A, 8C), stacking surface 11 is raised in substantially horizontal position and away from the stack.

The at least one first or second control profile (15, 18) is, for example, formed in a groove 19, 20. Third portion 18*c* connects, for example, the two grooves 19, 20.

First control profile 15 may comprise two stops, for example, formed at both ends of groove 19 for the two extreme positions: vertical front and stowed.

The at least one first control profile 15 and the at least one second control profile 18 may be offset laterally. For example, it is provided to shape control profiles 15, 18 in two grooves 19, 20 of different thicknesses, first control profile 15 being, for example, formed in deepest groove 19

(FIG. 3). This prevents the at least one first follower roller 14 from cooperating with the at least one second control profile 18, in particular when first follower roller 14 following first control profile 15 returns from the stowed position and crosses second control profile 18 to be in the retracted position.

Actuating device 12 may further include at least one elastic member 21, such as a tension spring, of which one extremity 21*a* is fixed, for example, secured to support 16, and the other extremity 21*b* is secured to surface stacking 11 (FIG. 4). Elastic member 21 ensures that follower rollers 14, 17 always lean on the same side of groove 19, 20 to cooperate with control profiles 15, 18 respectively.

The cam means comprise, for example, two first follower rollers 14, each secured to a respective end of stacking surface 11, and two first control profiles 15 cooperating with a respective first follower roller 14. In addition, the cam means may also comprise two second follower rollers 17 and two second control profiles 18 cooperating with a respective second follower roller 17. Second follower rollers 17 are each secured to a respective extremity of stacking surface 11 below a first follower roller 14.

First control profiles 15 and second control profiles 18 are, for example, formed in two supports 16, which are arranged laterally, on each side and at each extremity of stacking surface 11 (FIG. 2).

The drive of stacking surface 11 is, for example, made by means of at least one actuator 22.

Actuating device 12 comprises, for example, two actuators 22, each connected to one end of stacking surface 11 (FIG. 2).

The rod of the at least one actuator 22 is, for example, connected to an actuating point located on the back of first follower roller 14 (FIG. 4).

According to one example of embodiment, the at least one actuator 22 comprises a double pneumatic jack configured to move stacking surface 11 between the retracted position and the vertical forward position over a short stroke, and to move stacking surface 11 between the retracted position and the stowed position over a long stroke.

An example for operating a stacking device 10 in a reception zone 2 of a sheet receiving station 500 will now be described.

In production, stacking surface 11 is reciprocatingly movable between the vertical forward position (FIGS. 5A, 5B, 8A) and the retracted position (FIG. 6A, 6B, 8B) for stacking the sheets one by one after forming to form a stack.

Guiding stacking surface 11 on the jogging movement is achieved by the reciprocating movement of first follower rollers 14 against the small portions of straight first control profiles 15 and second follower rollers 17 against curved first portions 18*a* of second control profiles 18.

Thus, in the vertical forward position, stacking surface 11 is placed vertically and pushes the sheet to position it in a stack (FIG. 5A, 5B, 8A). In the retracted position, stacking surface 11 has pivoted and slightly shifted back from the stack (FIG. 6A, 6B, 8B).

When the user wishes to sample a transformed sheet, he controls actuators 22 on the long stroke to tilt stacking area 11 into the stowed position (FIG. 7A, 7B, 8C) to open the access of the stack of sheet-shaped elements P.

First follower rollers 14 continue their movements on the large portions of straight first control profiles 15 without discontinuity and second follower rollers 17 continue their movements on straight second portions 18*b* of second control profiles 18. Stacking surface 11 is thus moved into the stowed position, for example, by forming an angle of less than 30° with the horizontal. In this stowed position (FIG. 7A, 7B, 8C), stacking surface 11 is raised in the upper position, substantially horizontal above the stack. Between the retracted position and the stowed position, stacking surface 11 has pivoted and moved backwards. Stowing of stacking area 11 away and above the stack opens a wide access area for sampling a control sheet.

After taking the sample, stacking surface 11 is controlled in the retracted position. Follower rollers 14, 17 then follow control profiles 15, 18 in the opposite direction. First follower rollers 14 cannot follow second control profiles 18 when they cross them because of differences in the thicknesses of grooves 19 and 20.

The invention claimed is:

1. A stacking device for stacking sheet-shaped elements in a stack in a forming machine, the stacking device comprising:

a movable stacking surface, and an actuating device for moving the movable stacking surface:

between a retracted position and a vertical forward position in a reciprocating back-and-forth motion for stacking sheets, wherein a contact surface of the movable stacking surface is configured to rotate to space the contact surface away from the sheet-shaped elements of the stack in the retracted position and to contact edges of the sheet-shaped elements of the stack in the vertical forward position, and between the retracted position and a stowed position to open an access to a stack of sheet-shaped elements, wherein the actuating device comprises cam means for moving the movable stacking surface upwardly in the stowed position, in a raised position to be located above a top of the stack of sheet-shaped elements, the cam means having at least one first follower roller secured to the movable stacking surface and at least one first control profile cooperating with the at least one first follower roller to guide displacement of the movable stacking surface, and wherein the actuating device includes at least one actuator to cause the displacement of the movable stacking surface, wherein the at least one actuator includes a double pneumatic jack, the cam means includes:

at least one second follower roller secured to the movable stacking surface below the at least one first follower roller, and at least one second control profile cooperating with the at least one second follower roller, a first portion of the at least one second control profile is curved to guide movement of the movable stacking surface between the retracted position and the vertical forward position, and a second portion of the at least one second control profile has a straight part to guide the movement of the movable stacking surface between the retracted position and the stowed position.

2. The stacking device of claim 1, wherein the cam means configured to move the movable stacking surface between the retracted position and the stowed position are the same as those configured to move the movable stacking surface between said retracted position and the vertical forward position for stacking the sheets.

3. The stacking device of claim 1, wherein the at least one first control profile has a straight part.

4. The stacking device of claim 3, wherein the straight part of the at least one first control profile forms an angle of less than 30° with a horizontal.

5. The stacking device of claim 3, wherein the straight part of second portion of the at least one second control profile forms an angle of less than 30° with a vertical.

6. The stacking device of claim 1, wherein the second portion of the at least one second control profile intersects a direction of the at least one first control profile.

7. The stacking device of claim 1, wherein the at least one first follower roller and the at least one second follower roller are arranged on the movable stacking surface so that their cooperation with control profiles in the stowed position moves the movable stacking surface to an upper position forming an angle of less than 30° with a horizontal.

8. The stacking device of claim 1, wherein the at least one first control profile and the at least one second control profile are offset laterally to prevent the at least one first follower roller to cooperate with the at least one second control profile.

9. The stacking device of claim 1, wherein at least one of the at least one first control profile or the at least one second control profile is formed in a groove.

10. The stacking device of claim 1, wherein the actuating device comprises at least one elastic member having one fixed extremity and one extremity secured to the movable stacking surface to ensure contact of the at least one first follower roller on the at least one first control profile.

11. The stacking device of claim 1, wherein the cam means further includes:

two first follower rollers, each secured to a respective end of the movable stacking surface, and two first control profiles cooperating with a respective first follower roller.

12. The stacking device of claim 11, wherein the cam means further includes:

two second follower rollers, each secured to a respective end of the movable stacking surface below a first follower roller, and two second control profiles cooperating with a respective second follower roller.

13. The stacking device of claim 1, wherein the actuating device includes at least one elastic member.

14. A sheet-shaped element forming machine, comprising the stacking device according to claim 1.

15. A stacking device for stacking sheet-shaped elements in a stack in a forming machine, the stacking device comprising:

a movable stacking surface, and an actuating device for moving the movable stacking surface:

between a retracted position and a vertical forward position in a reciprocating back-and-forth motion for stacking sheets, and between the retracted position and a stowed position to open an access to the stack of sheet-shaped elements, wherein the actuating device comprises cam means for moving the movable stacking surface upwardly in the stowed position, in a raised position to be located above a top of the stack of sheet-shaped elements, the cam means having at least one first follower roller secured to the movable stacking surface and at least one first control profile cooperating with the at least one first follower roller to guide displacement of the movable stacking surface, and wherein the actuating device includes at least one actuator to cause the displacement of the movable stacking surface, the cam means includes:

at least one second follower roller secured to the movable stacking surface below the at least one first follower roller, and at least one second control profile cooperating with the at least one second follower roller, a first portion of the at least one second control profile is curved to guide movement of the movable stacking surface between the retracted position and the vertical forward position, a second portion of second control profile has a straight part to guide the movement of the movable stacking surface between the retracted position and the stowed position, and wherein the at least one actuator comprises a double pneumatic jack configured to move the movable stacking surface between the retracted position and the vertical forward position on a first stroke and to move the movable stacking surface between the retracted position and the stowed position on a second stroke longer than the first stroke.

16. A stacking device for stacking sheet-shaped elements in a stack in a forming machine, the stacking device comprising:

a movable stacking surface; and an actuating device configured to move the movable stacking surface between a stowed position for accessing the sheet-shaped elements of the stack and a vertical forward position for stacking the sheet-shaped elements of the stack, wherein a contact surface of the movable stacking surface is configured to rotate to space the contact surface away from the sheet-shaped elements of the stack in the stowed position and to contact edges of the sheet-shaped elements of the stack in the vertical forward position, wherein the actuating device is further configured to move the movable stacking surface between the vertical forward position and a retracted position between the vertical forward position and the stowed position, and wherein the actuating device is further configured to reciprocatingly move the movable stacking surface between the vertical forward position and the retracted position for each element of the sheet-shaped elements of the stack.

17. The stacking device of claim 16, wherein the actuating device includes:

a control profile, and a roller configured to guide a movement of the movable stacking surface to position the movable stacking surface between the stowed position and the vertical forward position.

18. The stacking device of claim 16, wherein the actuating device includes a double pneumatic jack.

* * * * *